US012268299B2

(12) United States Patent
Lim

(10) Patent No.: US 12,268,299 B2
(45) **Date of Patent: *Apr. 8, 2025**

(54) STORAGE RACK

(71) Applicant: Seville Classics Inc., Torrance, CA (US)

(72) Inventor: Gary Lim, Palos Verdes Peninsula, CA (US)

(73) Assignee: Seville Classics Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/407,248

(22) Filed: Jan. 8, 2024

(65) Prior Publication Data

US 2024/0138564 A1 May 2, 2024

Related U.S. Application Data

(63) Continuation of application No. 18/101,467, filed on Jan. 25, 2023, now Pat. No. 11,930,923, which is a continuation of application No. 17/693,345, filed on Mar. 12, 2022, now Pat. No. 11,564,488, which is a continuation of application No. 17/072,782, filed on Oct. 16, 2020, now abandoned, which is a continuation of application No. 16/693,277, filed on Nov. 23, 2019, now Pat. No. 10,806,252, which is a continuation of application No. 16/218,270, filed on Dec. 12, 2018, now Pat. No. 10,485,337, which is a continuation of application No. 15/881,742, filed on (Continued)

(51) Int. Cl.

| | |
|---|---|
| ***A47B 47/04*** | (2006.01) |
| ***A47B 47/00*** | (2006.01) |
| ***A47B 96/02*** | (2006.01) |
| ***A47F 5/10*** | (2006.01) |

(52) U.S. Cl.

CPC ..... *A47B 47/047* (2013.01); *A47B 47/00* (2013.01); *A47B 47/0058* (2013.01); *A47B 47/045* (2013.01); *A47B 96/021* (2013.01); *A47F 5/10* (2013.01)

(58) Field of Classification Search

CPC ... A47F 5/10; A47F 5/13; A47B 47/00; A47B 47/027; A47B 47/047; A47B 47/0058; A47B 47/045; A47B 96/021; A47B 96/024; A47B 57/265; A47B 57/54

USPC ..... 211/134, 186, 187, 189, 191, 192; 108/107, 108, 144.11, 147.11, 147.12, 108/147.13, 147.14, 147.15

See application file for complete search history.

(56) References Cited

U.S. PATENT DOCUMENTS

| | | | | |
|---|---|---|---|---|
| 2,714,540 A * | 8/1955 | Diehm | ..... | A47B 3/12 108/155 |
| 3,042,221 A * | 7/1962 | Rasmussen | ..... | A47B 57/50 211/182 |

(Continued)

*Primary Examiner* — Patrick D Hawn

(74) *Attorney, Agent, or Firm* — Raymond Sun

(57) ABSTRACT

A rack has a frame and a plurality of shelves. Each shelf has an enclosing frame member that has two first sides connected by two second sides, a connecting bar that connects the first sides at about the center of the first sides, a plurality of slots provided on the inner surfaces of the second sides, and a plurality of slats, each slat having opposing ends that are fitted into opposing slots at the second sides, and with each slat being connected to the connecting bar. At least one connector is provided for removably connecting each shelf to a portion of the frame.

6 Claims, 12 Drawing Sheets

Related U.S. Application Data

Jan. 27, 2018, now Pat. No. 10,165,855, which is a continuation of application No. 15/488,242, filed on Apr. 14, 2017, now Pat. No. 9,877,578, which is a continuation of application No. 14/866,056, filed on Sep. 25, 2015, now Pat. No. 9,629,456, which is a continuation of application No. 14/167,787, filed on Jan. 29, 2014, now Pat. No. 9,144,332, which is a continuation of application No. 13/952,385, filed on Jul. 26, 2013, now Pat. No. 8,651,295, which is a continuation of application No. 12/800,986, filed on May 26, 2010, now Pat. No. 8,522,987.

(56) References Cited

U.S. PATENT DOCUMENTS 3,146,734 A * 9/1964 Kesilman ..... A47F 5/13 108/181
3,266,635 A * 8/1966 McConnell ..... A47B 57/402 211/187
3,285,428 A * 11/1966 Scheck ..... A47B 57/06 211/182
3,463,325 A * 8/1969 Rogers ..... A47B 57/00 211/187
3,846,944 A * 11/1974 Lambert ..... A47B 47/021 211/187
4,078,664 A * 3/1978 McConnell ..... A47B 96/00 108/159
4,132,178 A * 1/1979 Mueller ..... A47B 57/265 108/147.14
4,257,333 A * 3/1981 Pollack ..... A47B 57/265 108/147.13
4,342,397 A * 8/1982 Halstrick ..... A47B 57/402 211/182
4,549,665 A * 10/1985 Smitley ..... A47B 57/22 211/191
4,582,001 A * 4/1986 Leikarts ..... A47B 57/265 108/106
4,635,563 A * 1/1987 Hand ..... A47B 96/024 108/107
4,637,323 A * 1/1987 Nicely ..... A47B 57/26 108/107
4,673,323 A * 6/1987 Russo ..... F16B 25/0021 408/222
D291,165 S * 8/1987 Ray ..... D6/675.2
4,754,712 A * 7/1988 Olson ..... A47B 57/265 108/107
4,815,394 A * 3/1989 Ettlinger ..... A47B 57/265 108/107
4,852,501 A * 8/1989 Olson ..... A47B 57/265 108/107
4,895,382 A * 1/1990 Andersson ..... A47F 5/135 211/149
D309,838 S * 8/1990 Glattstein ..... D6/675.2
4,955,490 A * 9/1990 Schafer ..... A47B 57/581 211/187
4,964,350 A * 10/1990 Kolvites ..... A47B 47/04 108/107
4,978,013 A * 12/1990 Hogg ..... A47F 5/13 211/132.1
D314,101 S * 1/1991 Yau Kee ..... D6/675.2
D314,682 S * 2/1991 Kellems ..... D6/574
5,011,031 A * 4/1991 Konstant ..... A47B 47/027 211/191
D319,362 S * 8/1991 Kellems ..... D6/574
5,169,009 A * 12/1992 Bomze ..... A47B 47/0083 211/187
5,279,231 A * 1/1994 Kolvites ..... A47B 57/545 108/107
5,310,066 A * 5/1994 Konstant ..... A47B 47/022 108/109
5,628,415 A * 5/1997 Mulholland ..... A47B 47/027 211/186
D383,014 S * 9/1997 Sagol ..... D6/675.1
5,676,263 A * 10/1997 Chang ..... A47B 57/26 108/147.13
5,738,230 A * 4/1998 Goldstein ..... A47B 43/00 211/149
5,779,070 A * 7/1998 Dickinson ..... A47B 57/265 211/181.1
5,913,270 A * 6/1999 Price ..... A47J 37/0763 108/101
5,924,581 A * 7/1999 Chen ..... A47B 57/265 108/107
6,044,988 A * 4/2000 Yang ..... A47B 57/265 108/107
6,079,575 A * 6/2000 Wang ..... A47B 55/02 108/110
6,105,798 A * 8/2000 Gruber ..... B65G 1/023 211/151
6,119,881 A * 9/2000 Yang ..... A47B 55/02 108/147.13
6,142,321 A * 11/2000 West ..... A47B 45/00 108/143
6,173,846 B1 * 1/2001 Anderson ..... A47B 47/027 211/183
D440,793 S * 4/2001 Iannaccone ..... D6/691.6
D444,975 S * 7/2001 West ..... D6/574
6,302,284 B1 * 10/2001 Zonshin ..... A47B 47/0083 108/147.11
6,443,410 B1 * 9/2002 Lee ..... A47B 96/024 211/182
6,457,737 B1 * 10/2002 King ..... A47B 31/04 211/153
6,561,107 B1 * 5/2003 Wood ..... A47B 3/0812 108/132
6,739,463 B2 * 5/2004 Wishart ..... A47B 47/027 211/175
6,899,237 B2 * 5/2005 Trent ..... A47C 19/005 211/184
6,971,528 B2 * 12/2005 Chen ..... A47B 57/40 211/182
D569,180 S * 5/2008 Rathburn ..... D7/409
7,516,856 B2 * 4/2009 Lee ..... A47B 88/90 211/184
D602,712 S * 10/2009 Ho ..... D6/675.2
D626,356 S * 11/2010 Ho ..... D6/675.2
7,891,507 B2 * 2/2011 Shetler ..... A47B 55/00 211/135
D657,979 S * 4/2012 Sokol ..... D6/675.1
9,629,456 B2 * 4/2017 Lim ..... A47B 47/00
9,833,066 B2 * 12/2017 Hsu ..... A47B 47/0083
9,877,578 B2 * 1/2018 Lim ..... A47B 47/00
9,901,169 B1 * 2/2018 Schenker ..... A47B 43/00
2003/0131767 A1 * 7/2003 Chen ..... A47B 57/265 108/147.13
2004/0065633 A1 * 4/2004 Chen ..... A47F 5/13 211/187
2008/0169256 A1 * 7/2008 Shetler ..... A47B 96/021 211/153
2008/0308516 A1 * 12/2008 Li ..... A47B 87/0223 211/153
2009/0152225 A1 * 6/2009 Lee ..... A47B 47/024 211/187
2009/0184076 A1 * 7/2009 Lee ..... A47B 57/54 211/103
2010/0181274 A1 * 7/2010 Vargo ..... A47B 47/021 211/187
2011/0233164 A1 * 9/2011 Chang ..... A47B 57/14 211/188
2011/0290750 A1 * 12/2011 Lim ..... A47B 47/00 211/153
2014/0263135 A1 * 9/2014 Sabounjian ..... A47B 47/0058 211/186
2017/0208939 A1 * 7/2017 Tsai ..... A47B 47/0083
2017/0215581 A1 * 8/2017 Lim ..... A47B 47/00

* cited by examiner

STORAGE RACK

BACKGROUND OF THE INVENTION

1. Field of the Invention

The present invention relates to an article-holding rack for placing common household articles, and in particular, to a rack for holding articles.

2. Description of the Prior Art

Article-holding racks are used by people in their daily lives to hold common household articles such as towels, clothes, shoes, etc. Many of these racks can be folded or dis-assembled to reduce that overall size and profile for storage and transportation. Unfortunately, many of these conventional racks are still difficult to fold, or assemble and disassemble, so that storage and transport can be inconvenient. In this regard, the construction of many of these racks is rather complex, leading to increased costs of production or inconvenience to the user.

SUMMARY OF THE INVENTION

It is an object of the present invention to provide a rack for holding articles.

It is another object of the present invention to provide a rack that is easy to deploy and to store.

It is yet another object of the present invention to provide a rack that has a simple construction and which is easy to manufacture.

The present invention provides a rack that has a frame and a plurality of shelves. Each shelf has an enclosing frame member that has two opposing first sides connected by two opposing second sides, a connecting bar that connects the first sides at about the center of the first sides, a plurality of slots provided on the inner surfaces of the second sides, and a plurality of slats, each slat having opposing ends that are fitted into opposing slots at the second sides, and with each slat being connected to the connecting bar. At least one connector is provided for removably connecting each shelf to a portion of the frame.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

FIGS. 1-5 illustrate a rack according to one embodiment of the present invention. The rack has a foldable frame 20 and a plurality of removable shelves 22. The frame 20 and the shelves 22 can be made from one of a variety of materials, including a plastic, a type of resin, wood or bamboo.

Figure 1:
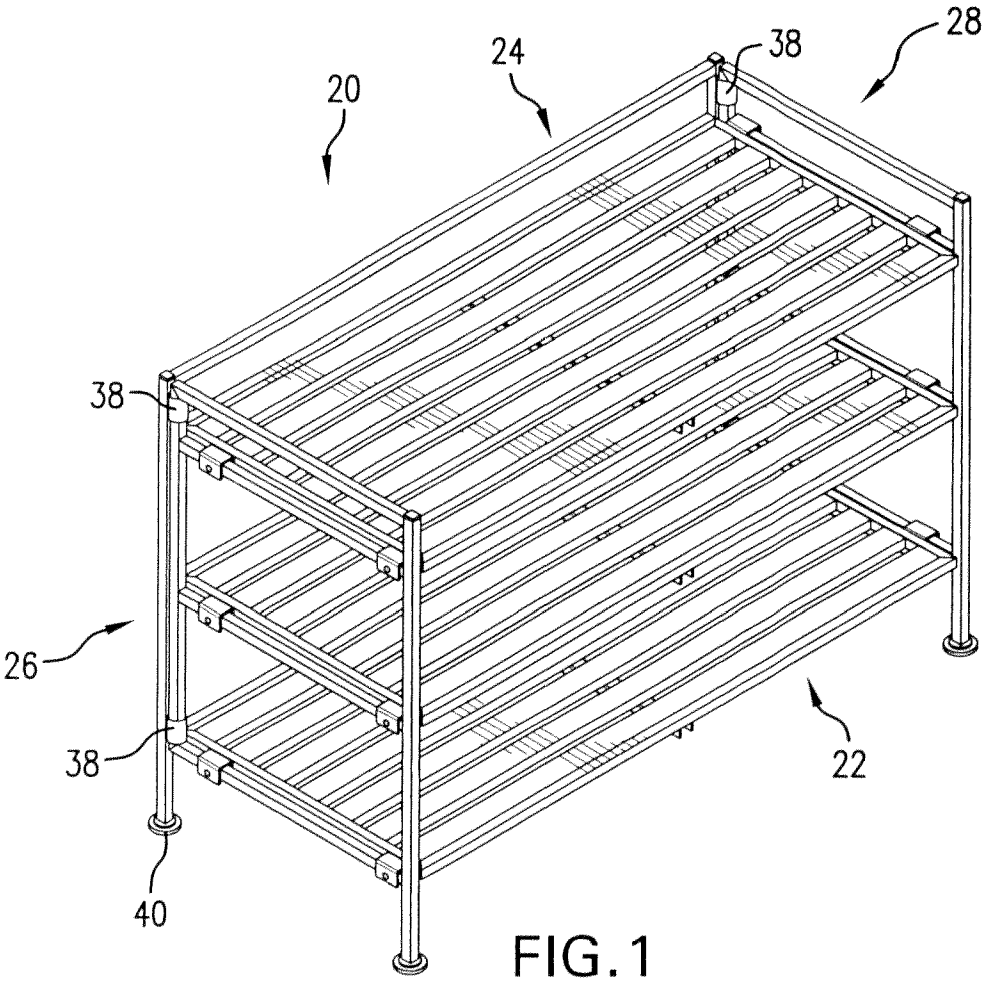
FIG. 1 is a perspective view of a rack according to one embodiment of the present invention.

The frame 20 has a rear support 24, a left support 26 and a right support 28. The rear support 24 has two vertical bars 30 and a plurality of horizontal bars 32 extending between the vertical bars 30. Similarly, the left and right supports 26 and 28 have a plurality of horizontal bars 34 extending between two vertical bars 36. The horizontal bars 32 and 34 are aligned at the same level because the horizontal bars 32, 34 at the same level function to attach a shelf 22. As best shown in FIG. 1, collars 38 are provided to pivotably connect the vertical bars 30 of the rear support 24 to a corresponding vertical bar 36 of the left support 26 or the right support 28. The vertical bars 30, 36 are received inside the collar 38 so that the supports 24+26 or 24+28 can pivot thereabout. As a result, the left support 26 and the right support 28 can be pivoted or folded towards each other to rest against the rear support 24 when the rack is disassembled and packaged for storage or transportation. Detachable feet 40 can be provided at the bottom of the vertical bars 30, 36.

Figure 2:
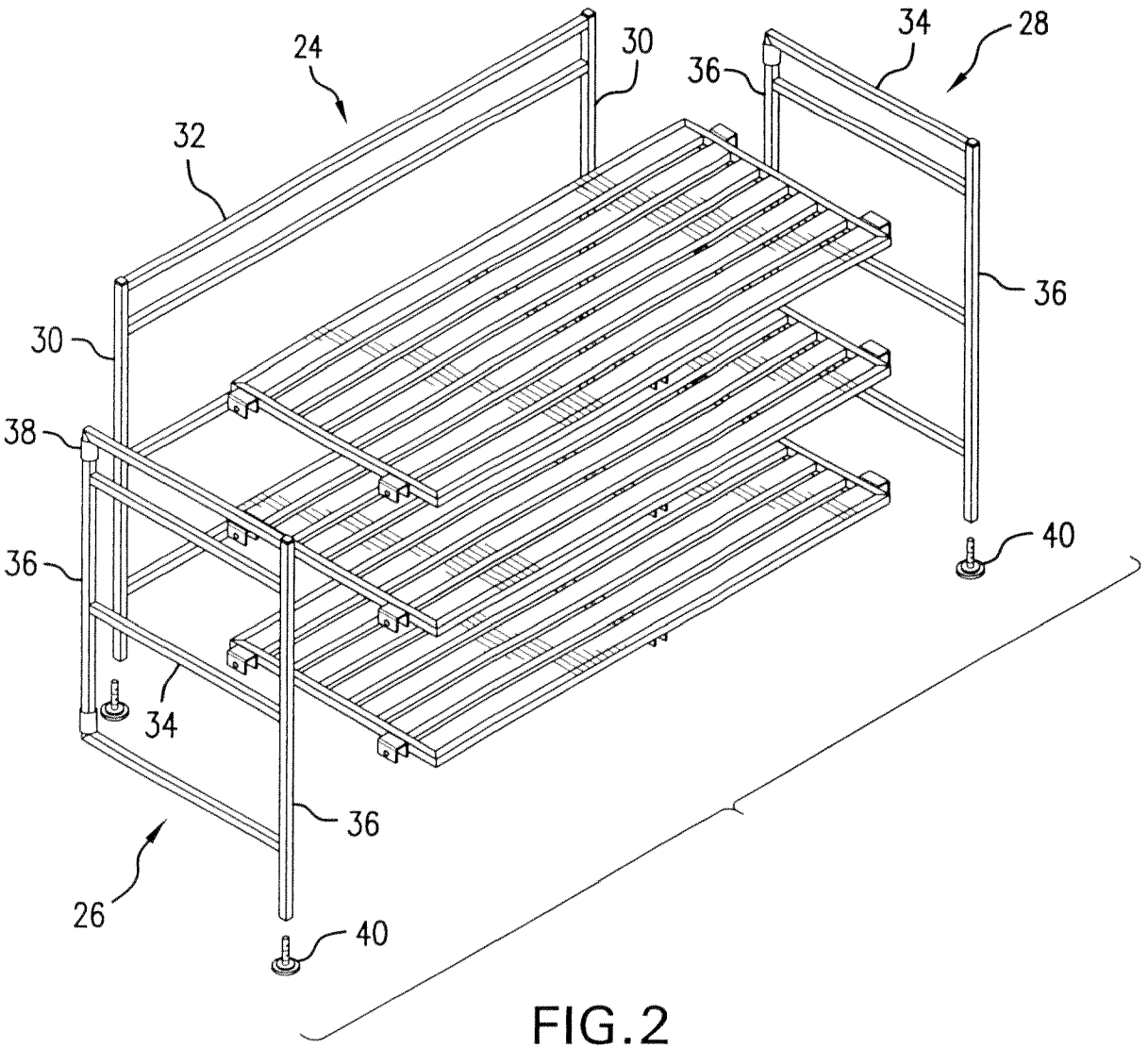
FIG. 2 is an exploded perspective view of the rack of FIG. 1.
Figure 3:
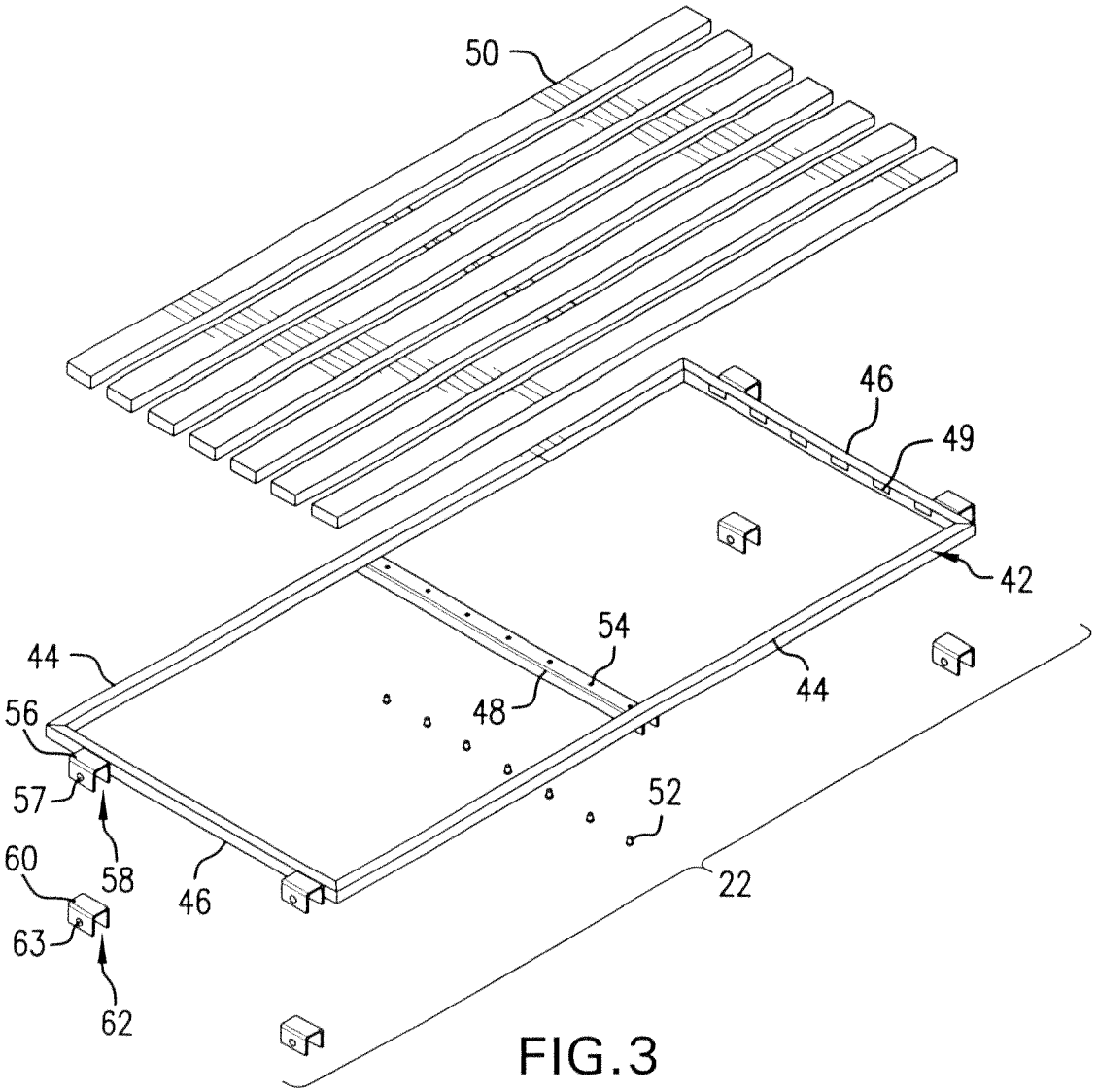
FIG. 3 is an exploded perspective view of a shelf of the rack of FIG. 1.
Figure 4:
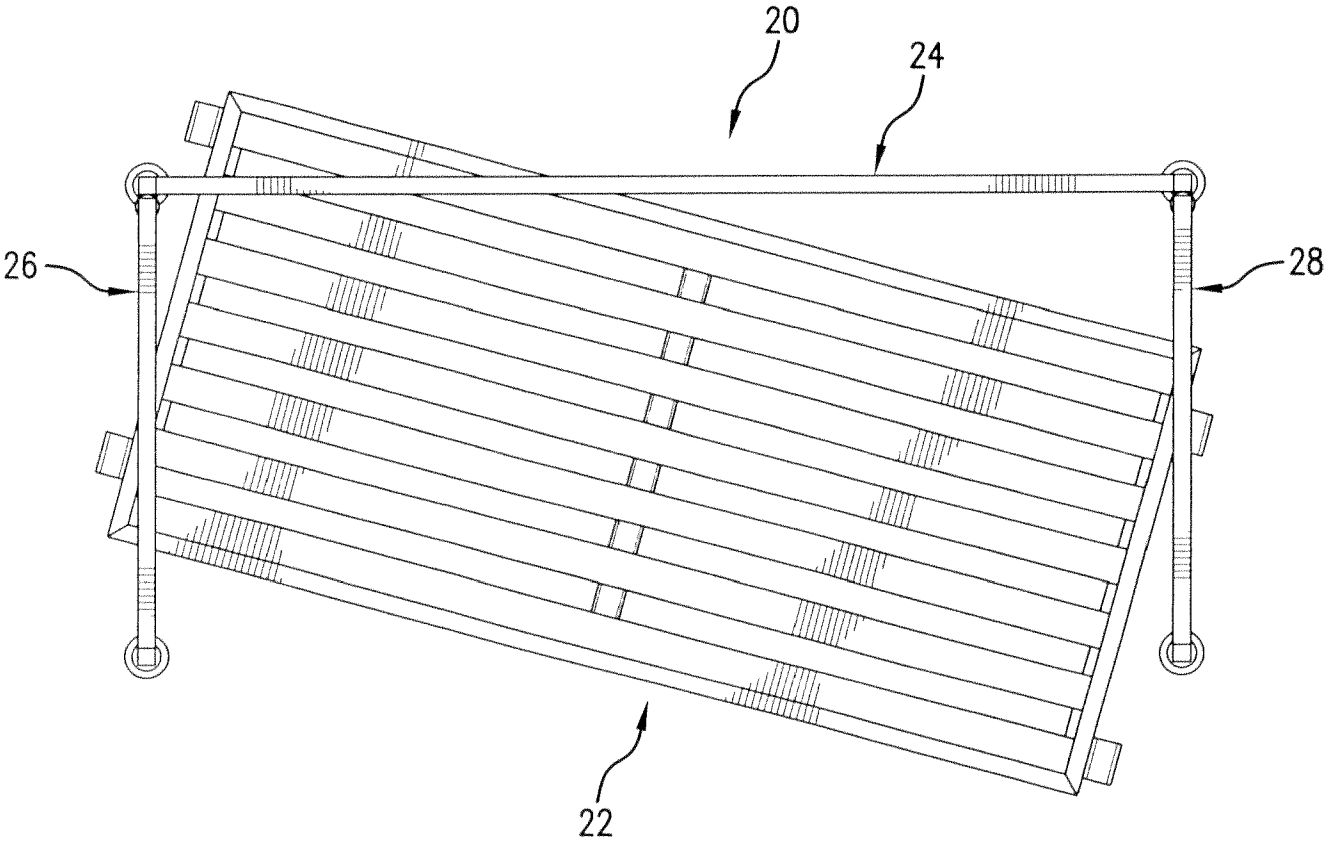
FIG. 4 is a top plan view illustrating how a shelf can be secured to the frame of the rack of FIG. 1.
Figure 5:
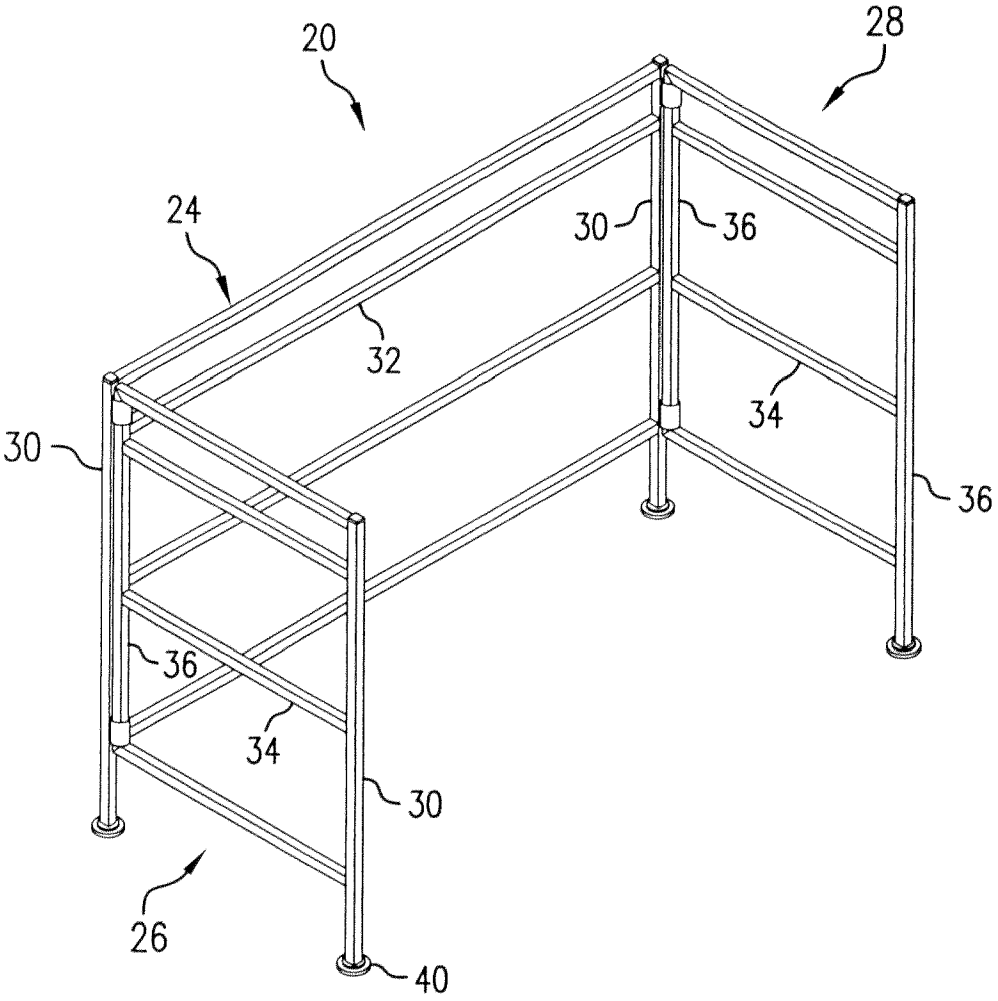
FIG. 5 is a perspective view of the frame of the rack of FIG. 1.

Each shelf 22 can have the same construction, and be coupled to the supports 26, 28 in the same manner. Referring in greater detail to FIG. 3, the shelf 22 has an enclosing frame member 42 that is generally rectangular in configuration, having two long sides 44 connected by two short sides 46. These sides 44 and 46 can be provided in the form of metal bars or metal sheets. The long sides 44 represent the front and rear sides, while the short sides 44 represent the left and right sides. A connecting bar 48 extends below the long sides 44 and connects the long sides 44 at about the center of the long sides 44. The inner-facing surfaces of the short sides 46 are provided with slots 49 that are aligned with opposing slots on the opposing short sides 46. These slots 49 are adapted to receive the opposing ends of a plurality of slats 50. Each slat 50 can be configured as an elongated strip of material. To assemble the shelf 22, each slat 50 is slightly bent to fit its opposite ends into the opposing slots 49 at the short sides 46. A screw 52 (or rivets, glue, tape or other similar connecting mechanisms) can then be inserted through corresponding holes 54 in the bar 48 to secure the slat 50 to the bar 48 at about the center of the slat 50. This construction relies on fitting opposite ends of the slat 50 (without a connection) into opposing slots 49, and then securing the center of the slat 50 to the bar 48, thereby providing a construction that is simpler than trying to secure (via an active connection) the ends of each slat 50 to the short sides 46 of the frame 42. Since the slats 50 are preferably made of a material that has some flex or resilience to it (e.g., plastic or a resin-like material), the slats 50 can be slightly bent for insertion of its ends into the slots 49. As shown in FIGS. 1-3, the slats 50 extend from one short side 46 to another short side 46 (i.e., from a left side to a right side) in a manner parallel to the long sides 44 (i.e., the front and rear sides).

In addition, a plurality of hooked connectors 56 can be secured to the exterior surfaces of the short sides 46. Each connector 56 has an inverted U-shape which defines two side walls and a top wall that define a receiving space 58. A lining 60 is snap-fitted into the space 58 of each connector 56 by causing a wedge 63 on an outer surface of the lining 60 to be fitted into a corresponding hole 57 in a side wall of the connector 56. Each lining 60 also defines a receiving space 62. To secure the shelf 22 to the left and right supports 26, 28, the shelf 22 can be maneuvered at an angle (see FIG. 4) between horizontal bars 32 of the rear support 24 and horizontal bars 34 of the left and right supports 26, 28, and then all the linings 60 on one short side 46 of the shelf 22 are clipped on to a horizontal bar 34 of the left support 26, and all the linings 60 on the opposite short side 46 of the shelf 22 are clipped on to a horizontal bar 34 of the right support 26 that is aligned at the same level as the horizontal bar 34 of the left support 26. The horizontal bar 34 is received in the receiving space 62 of the lining 60. The lining 60 has the same configuration as (but is slightly smaller than) the connector 56, is made of a plastic or resin material, and functions to secure the shelf 22 to the horizontal bars 34. The lining 60 can be omitted if desired.

To disassemble the rack, the user lifts up each shelf 22, thereby disengaging the connectors 56 (and their linings 60) from the horizontal bars 34, to remove each shelf 22. The left and right supports 26, 28 are then folded against the rear support 24, and the shelves 22 stacked on top of the folded frame 20, to form a stack of frame 20 and shelves 22 that can be quickly and conveniently packed into a box or otherwise tied together via straps for storage and/or transportation.

Figure 10:
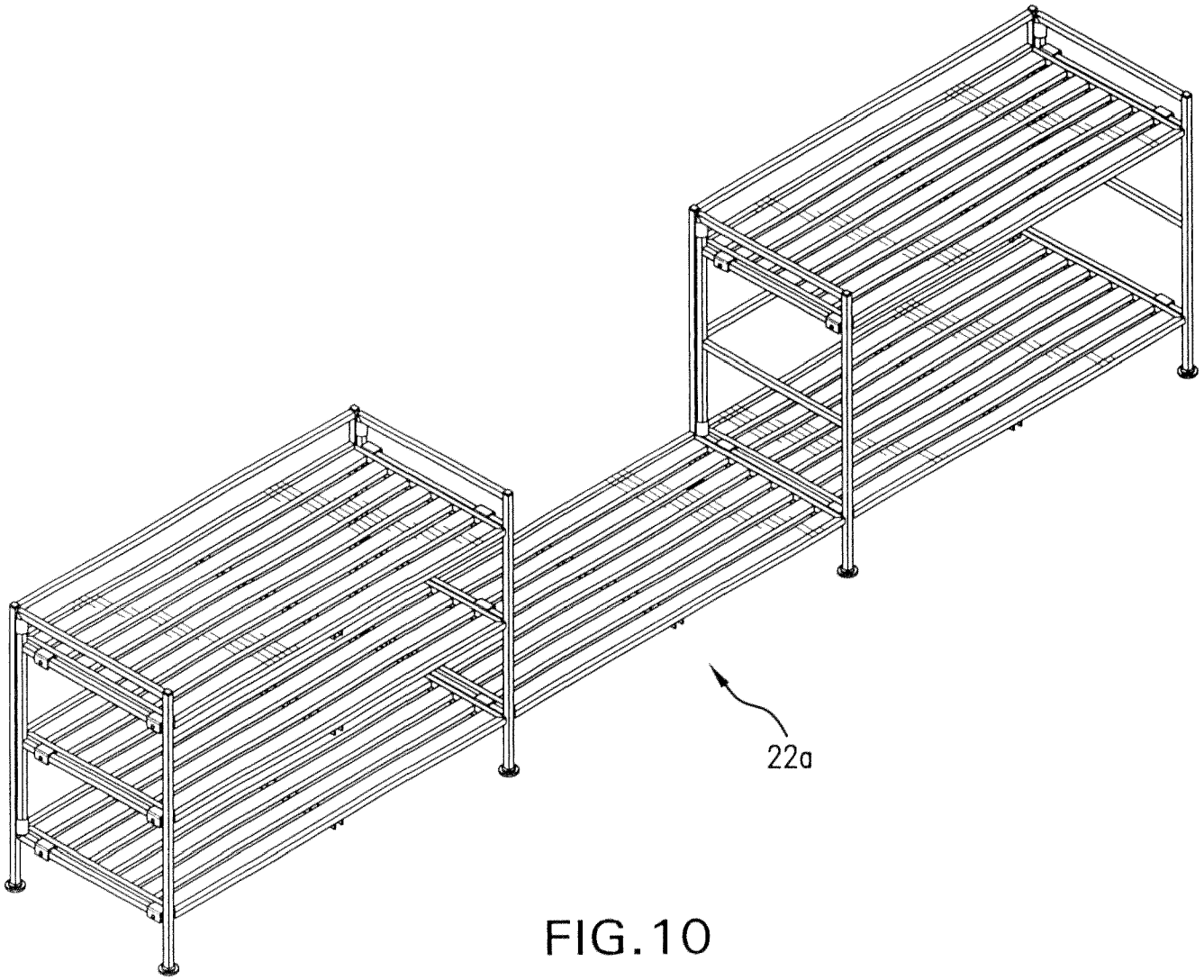
FIGS. 10-12 illustrate different configurations for the basic rack shown in FIGS. 1-3.
Figure 11:
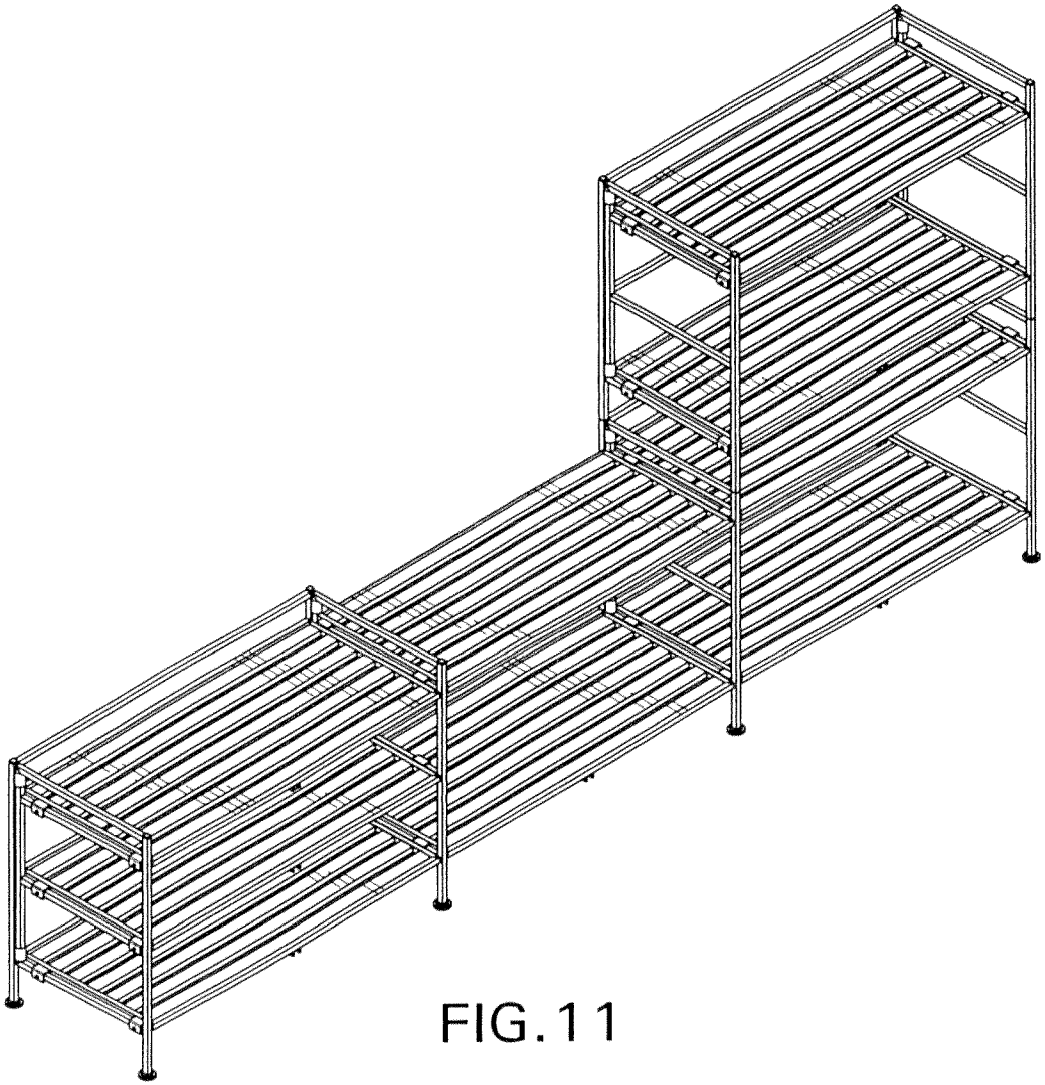

By using the basic components of the frame 20 and the shelves 22, the present invention can provide racks having many different configurations. For example, FIG. 10 illustrates two of the racks shown in FIG. 1 linked by another shelf 22*a*. As shown in FIG. 10, the same connector 56 can be used to secure the shelf 22*a* to horizontal bars 34 of the two separate racks. FIG. 11 applies the concepts of FIG. 10 except that the different racks have different heights and numbers of shelves.

Figure 12:
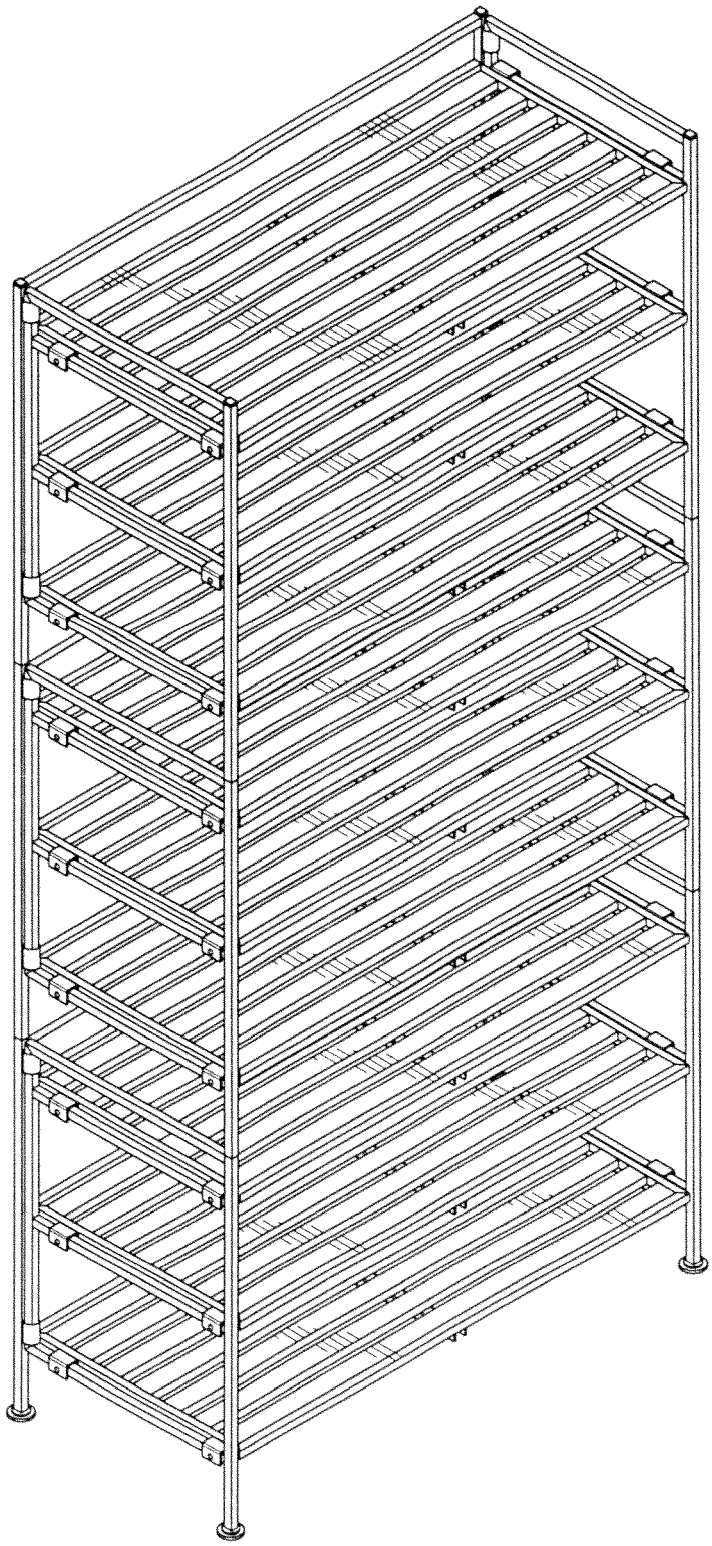

As another example, FIG. 12 shows the rack of FIG. 1 configured to be of a greater height to carry a greater of shelves 22. The overall rack shown in FIG. 12 can actually be comprised of three of the racks of FIG. 1 stacked one on top of the other.

Figure 6:
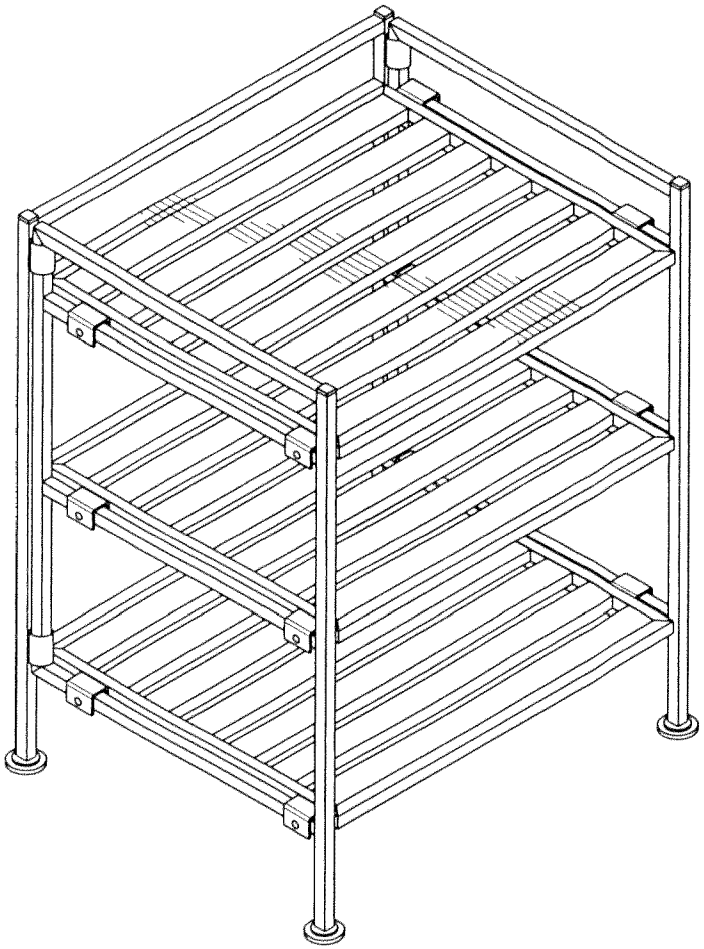
FIG. 6 is a perspective view of a rack according to another embodiment of the present invention.

FIGS. 6-9 illustrate modifications that can be made to the rack shown in FIGS. 1-3. For example, FIG. 6 illustrates the same rack in FIG. 1, except that the overall rack (and its shelves) have a square configuration such that there are no long or short sides, but the rack now has four sides of equal length.

Figure 7:
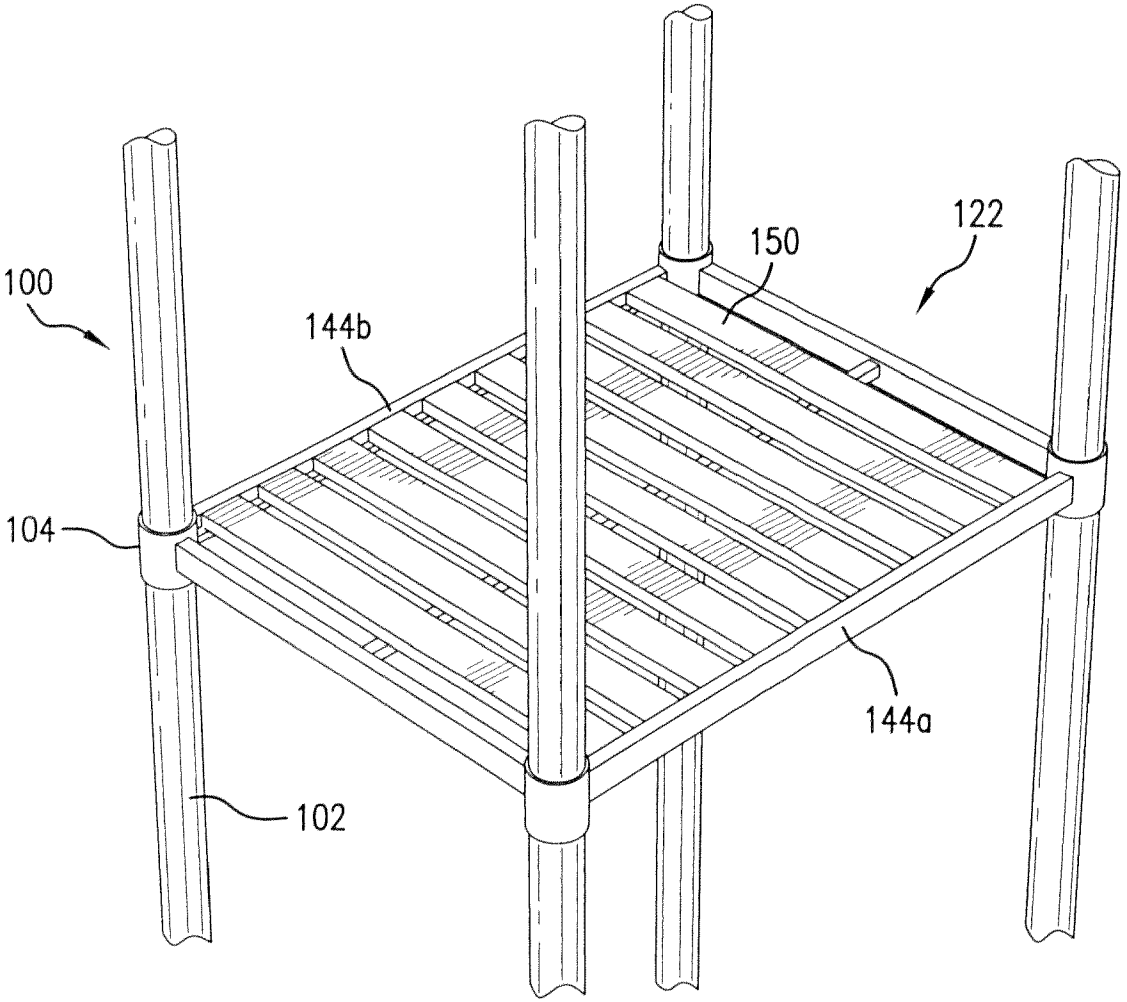
FIG. 7 illustrates modifications that can be made to the shelf of FIG. 3 and the rack of FIG. 1.
Figure 8:
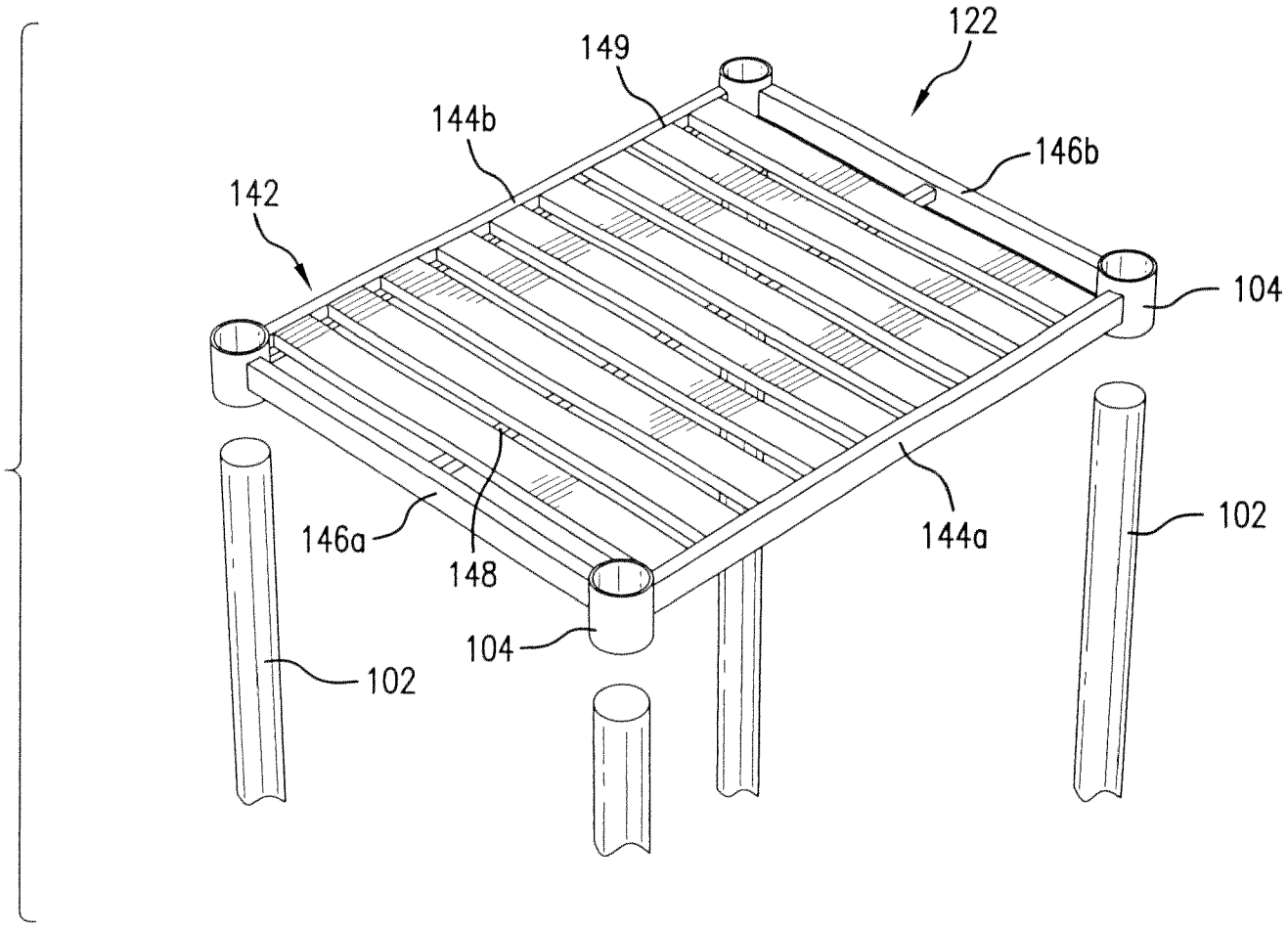
FIG. 8 is an exploded perspective view of FIG. 7.

As another example, FIGS. 7 and 8 illustrate a rack 100 that has two modifications to the rack in FIG. 1. First, the construction of the frame 20 from FIG. 1 is has been changed. Second, the slats 150 now extend from the front side 144*a* to the rear side 144*b* of each shelf 122.

The frame for the rack 100 is now composed of a plurality of support posts 102, each having ends that can be inserted into generally circular collars 104 provided at the corners of each shelf 122. The frame 142 of each shelf 122 is constructed by securing (e.g., by welding) the ends of the bars of the front side 144*a*, the rear side 144*b*, the left side 146*a* and the right side 146*b* to collars 104 positioned at the four corners of the shelf 122. A connecting bar 148 extends below the left and right sides 146*a*, 146*b* and connects the left and right sides 146*a*, 146*b* at about the center of these sides 146*a*, 146*b*. The inner-facing surface of the front side 144*a* is provided with slots 149 that are aligned with opposing slots 149 on the inner-facing surface of the opposing rear sides 144*b*, These slots 149 are adapted to receive the opposing ends of a plurality of slats 150, Each slat 150 can also be configured as an elongated strip of material. To assemble the shelf 122, each slat 150 is slightly bent to fit its opposite ends into the opposing slots 149, A screw (or rivet, glue tape or other connecting mechanisms) can then be inserted through corresponding holes in the bar 148 to secure the slat 150 to the bar 148 at about the center of the slat 150. This construction relies on fitting opposite ends of the slat 150 (without a connection) into opposing slots 149, and then securing the center of the slat 150 to the bar 148, thereby providing a construction that is simpler than trying to secure (via an active connection) the ends of each slat 150 to the sides 144*a*, 144*b*. Since the slats 150 are preferably made of a material that has some flex or resilience to it (e.g., plastic or a resin-like material), the slats 150 can be slightly bent for insertion of its ends into the slots 149. As shown in FIGS. 7-8, the slats 150 extend from the front side 144*a* to the rear side 144*b* in a manner parallel to the left and right sides 146*a*, 146*b*.

Figure 9:
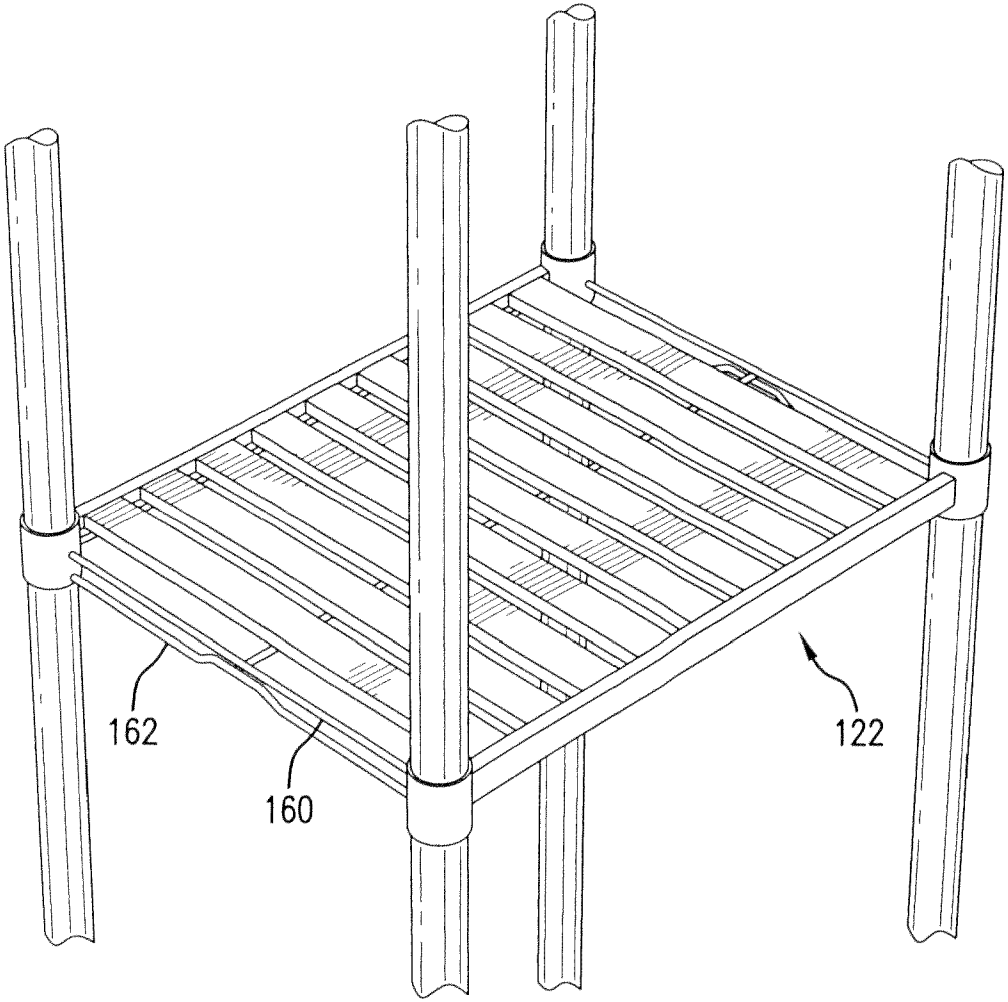
FIG. 9 illustrates a modification that can be made to the shelf of FIG. 7.

FIG. 9 illustrates a further modification that can be made to the rack 100 shown in FIGS. 7-8. The two sides (e.g., the left and right sides 146*a*, 146*b*) of the shelf 122 that do not contain the slots 149 can be formed by two metal wires 160, 162 instead of as a solid bar or metal sheet. Such a construction allows for the shelf 122 to be formed with a less weight and less material, thereby reducing costs even further.

Thus, the present invention provides a rack for holding articles. The rack has a shelf design that is simple so that it can be easily and conveniently assembled at the factory. The rack of the present invention can be easily assembled or disassembled, thereby making the storage and transport of the rack very easy.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A rack for holding articles, comprising:

a frame having a left support, and a right support;

a plurality of shelves, each shelf having:

an enclosing frame member that has two opposing first sides connected by two opposing second sides, with each second side having an interior defined by a first surface and a second surface that is opposite to the first surface, wherein each second side has a planar top surface and a planar bottom surface, and wherein the second surface, the planar top surface and the planar bottom surface are formed in one piece;

at least one slot provided on each of the first surfaces of the second sides, each slot defining an opening located entirely between the planar top surface and the planar bottom surface of the corresponding second side;

a plurality of separate elongated slats, each slat having a length that is greater than its width, each slat having a plurality of outer surfaces that encircle a four-sided cross-section so that the cross-section of each slat is retained inside a corresponding slot of the at least one slot, each slat having opposing ends that are positioned at opposing slots at the second sides in a manner such that each end of each slat is retained inside the interior of a corresponding second side, with the second surface completely covering the interior so that the ends of the slats are not visible from outside the second surface; and at least one connector for removably connecting one portion of a shelf to the left support, and another of the at least one connector for removably connecting another portion of the shelf to the right support.

2. The assembly of claim 1, wherein the first sides are longer than the second sides.

3. The assembly of claim 1, wherein the first sides and the second sides have the same length.

4. The assembly of claim 1, wherein the second sides are longer than the first sides.

5. The assembly of claim 1, wherein the at least one connector comprises a collar provided at a corner of each shelf, the frame comprising a plurality of support posts, each support post having an end that is inserted into one of the collars of one of the shelves.

6. The assembly of claim 1, wherein the four-sided cross-section of the slat is rectangular.

* * * * *